US005347724A

United States Patent [19]

Hankins

[11] Patent Number: 5,347,724

[45] Date of Patent: Sep. 20, 1994

[54] CROPPING TEMPLATE

[76] Inventor: Daniel C. Hankins, 1207 Forest Wood Cove West, Collierville, Tenn. 38017

[21] Appl. No.: 100,674

[22] Filed: Aug. 2, 1993

[51] Int. Cl.[5] ..... B43L 13/00

[52] U.S. Cl. ..... 33/563; 33/566; 33/DIG. 9; 33/1 B

[58] Field of Search ..... 33/563, 566, 1 G, 1 B, 33/1 AA, DIG. 9

[56] References Cited

U.S. PATENT DOCUMENTS 2,534,961 12/1950 Dunn ..... 33/DIG. 9 X
4,461,086 7/1984 Segletes ..... 33/563 X
4,475,288 10/1984 Pellegrom ..... 33/1 B
4,515,077 5/1985 Davidson et al. ..... 33/1 B X

FOREIGN PATENT DOCUMENTS 2110167 6/1983 United Kingdom ..... 33/564

*Primary Examiner*—William A. Cuchlinski, Jr.
*Assistant Examiner*—Alvin Wirthlin

[57] ABSTRACT

Apparatus is disclosed in which a transparent or translucent plastic template of a specific size bears a combination of inscribed marks and apertures adapted to cooperate with each other so as to enable a user to readily align, make page size and margin determinations, and draw marks on materials to be cropped and/or hole-punched in a manner that is quick, easy, and makes optimum use of both the user's time and the cropped material.

2 Claims, 2 Drawing Sheets

CROPPING TEMPLATE

BACKGROUND OF THE INVENTION

1. Field of the Invention:

This invention relates to templates used in the process of marking items for being cropped, or cut, to a predetermined size and desired alignment.

2. Discussion of the Prior Art:

Templates for use in drawing figures are commonly available for many drafting applications. Examples are described in U.S. Pat. Nos. Des. 284,089, Des. 288,538, and Des. 322,039. Many devices are available to form circles, while others bear complicated apertures for creating linear geometric forms. Finally, some combine both functions into a single device, such as U.S. Pat. Nos. 4,736,526 and 5,058,285. All function adequately for their intended purpose of aiding the drafting process. Such templates are normally in the form of a thin plastic panel having differently shaped and sized holes defined therein. When a certain figure is to be drawn using a template, the edge of a corresponding hole of the template is followed with a pencil, a pen, or the like which is being pressed against a drawing sheet. Such templates are useful in drawing various exactly alike figures such as computer program flowchart symbols, circles, ellipses, triangles, squares, and other shapes, without making actual dimensional measurements.

Although the drafting templates identified in the prior art are useful when applied to their intended purpose, none of the templates perform the functions of the present invention in a manner that would be readily appreciated by a person either skilled or unskilled in drafting template usage. Whereas some of the prior art templates do contain straight peripheral and/or internal edges by which lines could be drawn, as well as circular apertures, or holes, that could be used to draw circles, none of the prior art templates have been configured in a manner whereby all of the following features are aligned to coincide with the most commonly found loose leaf page sizes used in multi-ring receptacles such as day-planner type personal organization binders, to wit: the length of the external peripheral edges; the lines inscribed within the template; and the plurality and sizes of holes. None of the prior art templates incorporate lines or other markings simulating customary boundaries for a printed page, whereby the user quickly can visualize and align the template for the optimum alignment of the material being cropped. None of the prior art templates incorporate holes specifically sized to coincide with the customary hole sizes for the most commonly found loose-leaf page sizes used in said multi-ring receptacles. None of the prior art templates incorporate narrow rectilinear holes or slots for marking in a configuration that permits the embodiment of multiple template sizes into one template panel.

The use of any of the prior art examples as a cropping template would entail a considerable amount of time on the part of the user to determine and mark both the appropriate peripheral size of the desired page as well as the proper location and alignment of the holes to be punched for use with a multi-ring, loose-leaf binder, or similar receptacle. Even persons skilled in the use of draining templates would normally require a considerable number of trial and error attempts prior to their being able to use one of the prior art templates in a manner that would accomplish results similar to that which a person, who is both unskilled in the use of draining templates and a new user of the present invention, can accomplish on the first try and within seconds of beginning the cropping procedure.

It is the primary object of the present invention, therefore, to provide a template which allows persons who have never used any type of drafting template quickly and easily to align and mark paper or other material for cropping to a predetermined size, and, if desired, mark the material for hole-punching for inclusion in an appropriate receptacle such as a multi-ringed, loose-leaf binder (e.g., personal organization day-planner binder, etc.).

SUMMARY OF THE INVENTION

The above object is achieved in accordance with the present invention template comprising a thin (relative to its other dimensions), rectangular panel (defined by length and width) having straight edges extending on the periphery thereof and a plurality of circular holes defined therein as having respective centers positioned on an imaginary line parallel to the panel's longitudinal axis (i.e., length). When more than one size template is included in the panel, a plurality of narrow rectilinear holes (or slots) are included for the purpose of enabling the user to mark reference lines by which the peripheral outline of a page size that is smaller than the periphery of the overall template itself can be drawn, and a corresponding plurality of circular holes defined therein as having respective centers positioned on an imaginary line parallel to the longitudinal axis of this smaller-sized template figure. Both for durability and for service as a drawing guide, the template is formed of a rigid or semi-rigid material. Preferably, the material is conducive to easy manufacture, such as a plastic (preferably acrylic) material.

Said circular holes in the present invention are to be used for the purpose of marking the material being cropped both for the purpose of hole punching and to determine visually sufficient margin clearance so that desirable printed matter is not eliminated by the punched holes. When a single-hole punching device is to be used, for alignment purposes it is highly desirable for the user to trace or mark on the material to be cropped the positions for holes, by means of the circular holes embodied in the template. When using a multi-hole punching device to punch all holes at once, however, the actual marking of the hole positions is optional, so long as the user is careful that desirable printed matter will not be destroyed.

Using the template thus constructed, the user can determine quickly and easily: a) whether all desirable information will be included in the material to be cropped; b) whether holes to be punched, if desired are properly located; and c) that the information desired will be aligned appropriately within the customary border allowances for printed matter on pages of the size selected.

Further objects and advantages of the invention will become apparent from a consideration of the drawings and the ensuing description.

DETAILED DESCRIPTION OF THE PREFERRED EMBODIMENT(S)

Figure 1:
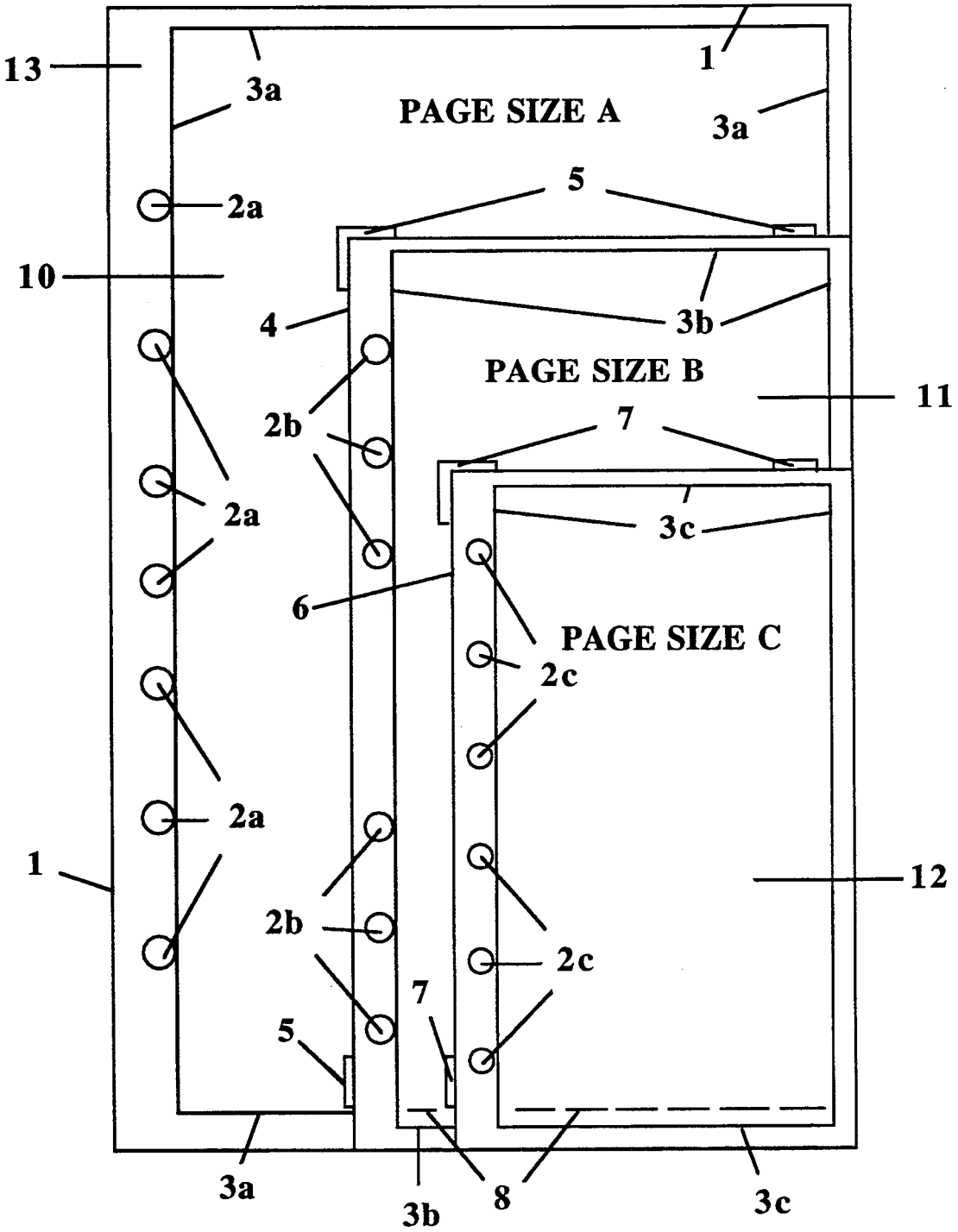
FIG. 1 is a front elevation view of a template for cropping materials according to an embodiment of the present invention when more than one size cropping template is included in the design of the overall template. This particular embodiment depicts a template that comprises three different page size cropping templates into a single template.

Referring to FIG. 1, a three page size-in-one template 13 is disclosed for marking peripheral lines for cropping and for marking holes to be punched according to an embodiment of the present invention which includes a figure panel 10 comprised of thin, transparent or semi-transparent plastic. Said figure panel 10 is rectangular in shape having a plurality of lines 3*a* which are parallel to the external peripheral edges 1 of figure panel 10 and that have been inscribed or printed onto the panel to represent the customary margins for printed matter on the page size selected (i.e., Page Size A). Said figure panel 10 also contains a vertical row of holes 2*a* defined therein and having respective centers positioned on an imaginary line (not shown) parallel to the longitudinal axis of the panel. Said holes 2*a* are spaced along the imaginary line in accordance with the customary spacing liar the number of holes provided in multi-ringed receptacles, such as personal organization binders which employ the particular page size selected. Within, or internal to, said figure panel 10 are lines 4 representing the external peripheral edges of a smaller page-size template referred to as figure panel 11 (Page Size B) incorporated into the three page size-in-one template 13. The figure panel 10 has narrow slots 5 strategically located along the external periphery of figure panel 11 through which marks may be drawn onto the material to be cropped in order to accurately draw the external peripheral edges of the smaller page-size template referred to as figure panel 11. Also within, or internal to, both said figure panels 10 and 11 are lines 6 representing the external peripheral edges of the smallest page-size template, referred to as figure panel 12 (Page Size C), incorporated into the three page size-in-one template 13. The figure panel 11 also has narrow slots 7 strategically located along the external periphery of figure panel 12 through which marks may be drawn onto the material to be cropped in order to accurately draw the external peripheral edges of figure panel 12. Slightly above the lower margin lines 3*b* and 3*c* within figure panels 11 and 12, respectively, are dotted or dashed lines 8 inscribed into or printed onto the template for the purpose of visually representing the horizontal continuation of the bottom margin line 3*a* of figure panel 10 due to said bottom margin line 3*a* in figure panel 10 being slightly wider than the bottom margin lines 3*b* and 3*c* of figure panels 11 and 12, respectively. Based on the inventor's own research, three of the more popular page sizes for personal organization planners (loose-leaf type) appear to be: (a) $5\frac{1}{2}\times8\frac{1}{2}$ inches with top and bottom borders of $\frac{1}{4}$ inch and a right edge border of $\frac{1}{8}$ inch and seven 9/32 inch diameter holes (suggested Page Size A); (b) $4\frac{1}{4}\times6\frac{3}{4}$ inches with $\frac{1}{8}$ inch borders and six 7/32 inch holes (suggested Page Size B); and (c) $3\times5$ inches with $\frac{1}{8}$ inch borders and six 3/16 inch diameter holes (suggested Page Size C). Of course, the invention template, as depicted in FIG. 1 or as depicted in FIG. 2, may have different numbers of holes and may be sized as desired without deviation from the subject matter which the inventor regards as his invention.

Figure 2:
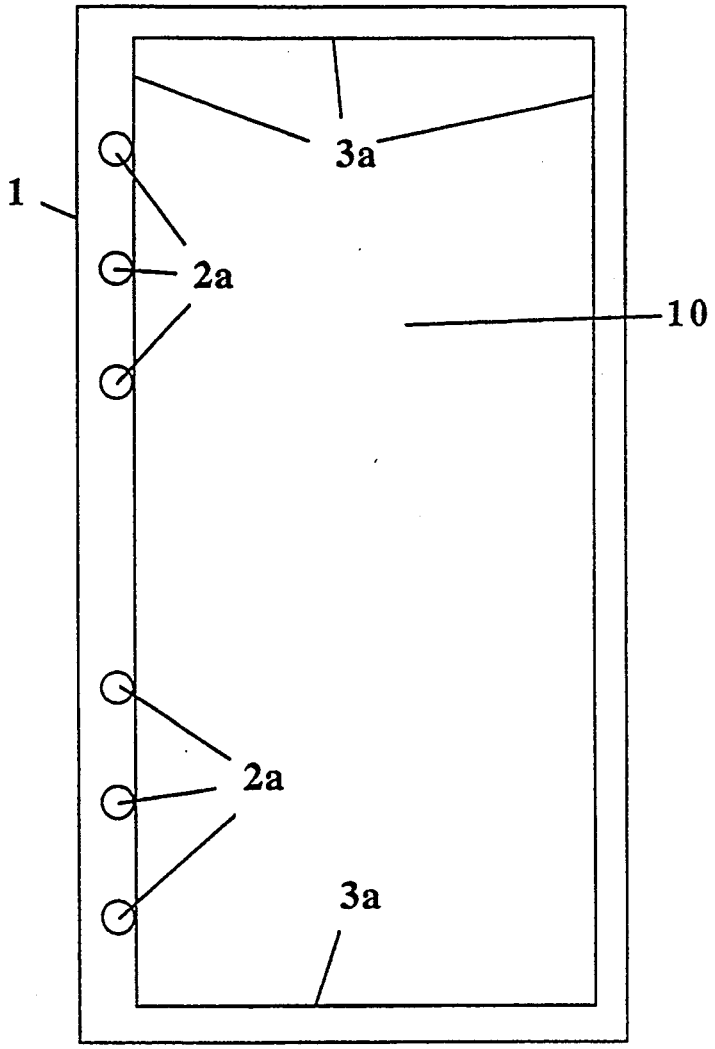
FIG. 2 is a front elevation view of a template for cropping materials according to another embodiment of the present invention when a single page-size cropping template is provided.
Figure 3:
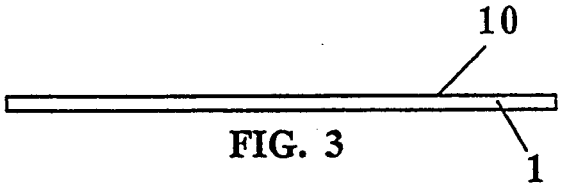
FIG. 3 is a side elevation view of the template in any of its embodiments when viewed from either of its shorter side edges.
Figure 4:
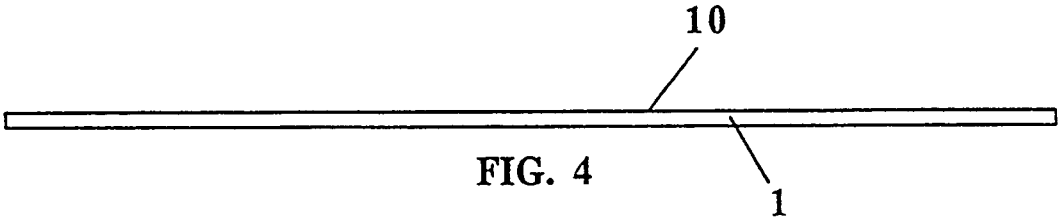
FIG. 4 is a side elevation view of the template in any of its embodiments when viewed from either of its longer side edges.

Referring to FIG. 2, a single page-size figure panel/-template 10 is disclosed for marking peripheral lines for cropping and for marking holes to be punched according to an embodiment of the present invention which includes figure panel 10 preferably comprised of thin, transparent or semitransparent plastic. Said figure panel 10 is rectangular in shape having lines 3*a* which are parallel to the external peripheral edges 1 of figure panel 10 and that have been inscribed (by etching) or printed onto the panel to represent the customary margins for printed matter for that page size. Said figure panel 10 also contains a vertical row of holes 2*a* defined therein and having respective centers positioned on an imaginary line (not shown) parallel to the longitudinal axis of the panel. Said holes 2*a* being spaced along the imaginary line in accordance with the customary spacing for the number of holes provided in multi-ringed receptacles, such as personal organization binders which employ this particular page size. Instead of employing the template of FIG. 1 which provides alternative paper sizes and hole configurations, one may choose to employ a multiple of templates as depicted in FIG. 2 of varied dimensions. FIG. 3 and FIG. 4 are provided to indicate the three dimensional aspect of the invention template.

The cropping templates/figure panel depicted in the figures are extremely easy to use and can be used quickly to produce professional-looking results almost immediately by users who have never used a cropping template or a drafting template. To use the template of either FIG. 1 or FIG. 2, the user simply places the material to be cropped onto a flat, smooth surface and then lays the template upon the material in a manner such that the template/figure panel is oriented in a direction corresponding with the desired outcome of the cropping procedure. The user adjusts the orientation of the template using the visual reference lines provided for the particular page size desired. Marking of lines or circles onto the material to be cropped is accomplished by use of a pencil, pen, or some other appropriate marking device.

Referring to FIG. 1, when Page Size A (represented by the entire figure panel 10) is the size desired, the visual reference lines 3*a* are used for margin determination and the peripheral edges 1 of figure panel 10 are used for aligning and marking purposes.

If the user desires to place the cropped material into a multi-ringed binder, the circular holes 2*a* are provided for marking the precise location for hole-punching the material consistent with the ring spacing of the most commonly found multi-ringed binders.

When Page Size B, depicted as figure panel 11, is the desired size, the user visually aligns figure panel 11 using visual reference lines 4 and 3*b*. Since the panel comprising the multiple size template-in-one embodiment 13 shown in FIG. 1 does not allow for the drawing of complete peripheral lines for the smaller page sizes, narrow slots 5 have been provided to allow the user to mark short reference lines depicting the peripheral outline of this page size. When the template is lifted from the material to be cropped, these short reference lines may be quickly connected to make a solid line for cutting purposes by using the external edge of the template as a straightedge thereby completing the marking of the peripheral outline of Page Size B. If the user desires to place the cropped material into a multi-ringed binder, the circular holes 2b are provided for marking the precise location for hole-punching the material consistent with the ring spacing of the most commonly found multi-ringed binders.

When Page Size C, depicted as figure panel 12, is the desired size, the user visually aligns figure panel 12 using visual reference lines 6 and 3c. Since the embodiment comprising the multiple size template-in-one embodiment shown in FIG. 1 does not allow for the drawing of complete peripheral lines for the smaller page sizes, narrow slots 7 have been provided to allow the user to mark short reference lines depicting the peripheral outline of Page Size C. When the template is lifted from the material to be cropped, these short reference lines may be quickly connected to make a solid line for cutting purposes by using an external edge 1 of the template as a straightedge thereby completing the marking of the peripheral outline of the page size selected. If the user desires to place the cropped material into a multi-ringed binder, the circular holes 2c are provided for marking the precise location for hole-punching the material consistent with the ring spacing of the most commonly found multi-ringed binders.

Once the alignment and marking of peripheral edges and holes have been accomplished, the user may crop the material either by using scissors or a paper cutter. Holes may be punched in the material either by using a hand-held, single-hole paper punch or by using one of several different models of multi-hole paper punches.

In summary, a novel tool has been disclosed and described in which a transparent or translucent plastic template bears a combination of inscribed marks and apertures adapted to cooperate with each other so as to enable a user to readily draw the outline of a desired page size and of holes for hole punching in material that is intended for cropping. The result is a simple, easy to use cropping template having the following advantages:

1. Enables user quickly to produce professional-looking results when cropping documents, spreadsheets, photographs, etc. that have been reduced in size by means of a xerographic photocopier having photo-reduction capabilities;
2. Extremely easy to use:
3. Rapid learning for unskilled users:
4. Allows for the most efficient use of the materials being cropped:
5. Allows user to maximize usage of his/her available time:
6. Easy and inexpensive to produce: and
7. May be conveniently stored in a multi-ringed binder.

While only two embodiments of the invention have been disclosed (and are inclusive of the best mode), they are merely representative of the principles of the invention; and it is anticipated and expected that those skilled in the art will readily recognize and utilize other embodiments falling within the scope of the invention. For example, the template can include geometric shapes for drafting purposes and ruler markings to aid in both drafting and general drawing purposes. It should be understood that many changes and modifications may be made therein without departing from the scope of the appended claims.

Thus, the scope of the invention should be determined by the appended claims and their legal equivalents, rather than merely by the figures depicted herein.

What I claim is:

1. A template for aligning with and marking materials to be cropped comprising (1) a rectangular panel with a thin depth, relative to its length and width dimensions, wherein said length and width are defined by straight edges each of which corresponds to the respective dimensions of the desired cropped material size, (2) a first plurality of circular holes defined therein and having their respective centers in alignment along an imaginary line parallel and adjacent to one side edge of the panel's length for marking holes to be punched out, (3) lines parallel to the straight edges defining the length and width of the rectangular panel and located at a respective distance from each said edge to define margins there between, one of which margins incorporates said aligned plurality of circular holes and wherein said lines are indicated by inscription or by printing on said template, (4) a multiple of alignments of said pluralities of circular holes at varying lengths (in addition to said first plurality) and a multiple of lines parallel to the straight edges, both said multiples corresponding to and defining varying dimensions of multiple desired cropped material sizes, wherein said multiple of lines parallel to the straight edges include lines defining the length dimension which incorporate each said multiple alignment of said pluralities of circular holes to form multiple borders, and (5) multiple straight narrow openings defining slots located at the respective border outer edges and multiple narrow openings defining 90° angle slots located at respective border corners defined by intersections of said parallel lines located in said template.

2. The template of claim 2 wherein the plurality of circular holes equals a number from three to seven.

* * * * *